US006244245B1

(12) United States Patent
Boecking

(10) Patent No.: US 6,244,245 B1
(45) Date of Patent: Jun. 12, 2001

(54) VALVE CONTROL UNIT FOR A FUEL INJECTION VALVE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/485,826

(22) PCT Filed: Mar. 10, 1999

(86) PCT No.: PCT/DE99/00641

§ 371 Date: Apr. 10, 2000

§ 102(e) Date: Apr. 10, 2000

(87) PCT Pub. No.: WO99/66193

PCT Pub. Date: Dec. 23, 1999

(30) Foreign Application Priority Data

Jun. 16, 1998 (DE) ..... 198 26 791

(51) Int. Cl.[7] ..... F02M 37/04
(52) U.S. Cl. ..... 123/300; 123/467
(58) Field of Search ..... 123/467, 299, 123/300, 500, 501, 495

(56) References Cited

U.S. PATENT DOCUMENTS 4,022,165 * 5/1977 Eckert et al. ..... 123/300
4,640,252 * 2/1987 Nakamura et al. ..... 123/446
5,575,253 * 11/1996 Lambert et al. ..... 123/300
5,862,793 * 1/1999 Jay et al. ..... 123/467
5,901,685 * 5/1999 Noyce et al. ..... 123/467
6,012,430 * 1/2000 Cooke ..... 123/467
6,085,719 * 7/2000 Heinz et al. ..... 123/300

FOREIGN PATENT DOCUMENTS

661442 * 7/1995 (EP) .
686763 * 12/1995 (EP) .

* cited by examiner

*Primary Examiner*—Carl S. Miller
(74) *Attorney, Agent, or Firm*—Ronald E. Greigg; Edwin E. Greigg

(57) ABSTRACT

A valve control unit for a fuel injection valve includes a housing body with two valve control chambers that continuously communicate with each other. An end member of a movable valve control piston can be moved inside the first valve control chamber and the first valve control chamber communicates with an inlet conduit for fuel. The second valve control chamber communicates with an outlet conduit that can be closed by a ball valve. The end member is comprised of an inner structural member and an outer structural member that can move in relation to each other. In the movement of the valve control piston, only the outer structural member is moved for a preinjection of fuel and the inner structural member is moved for the main injection. The quantity of preinjected fuel can be further minimized while an increased movement speed of the valve control piston is simultaneously possible during the main injection.

11 Claims, 1 Drawing Sheet

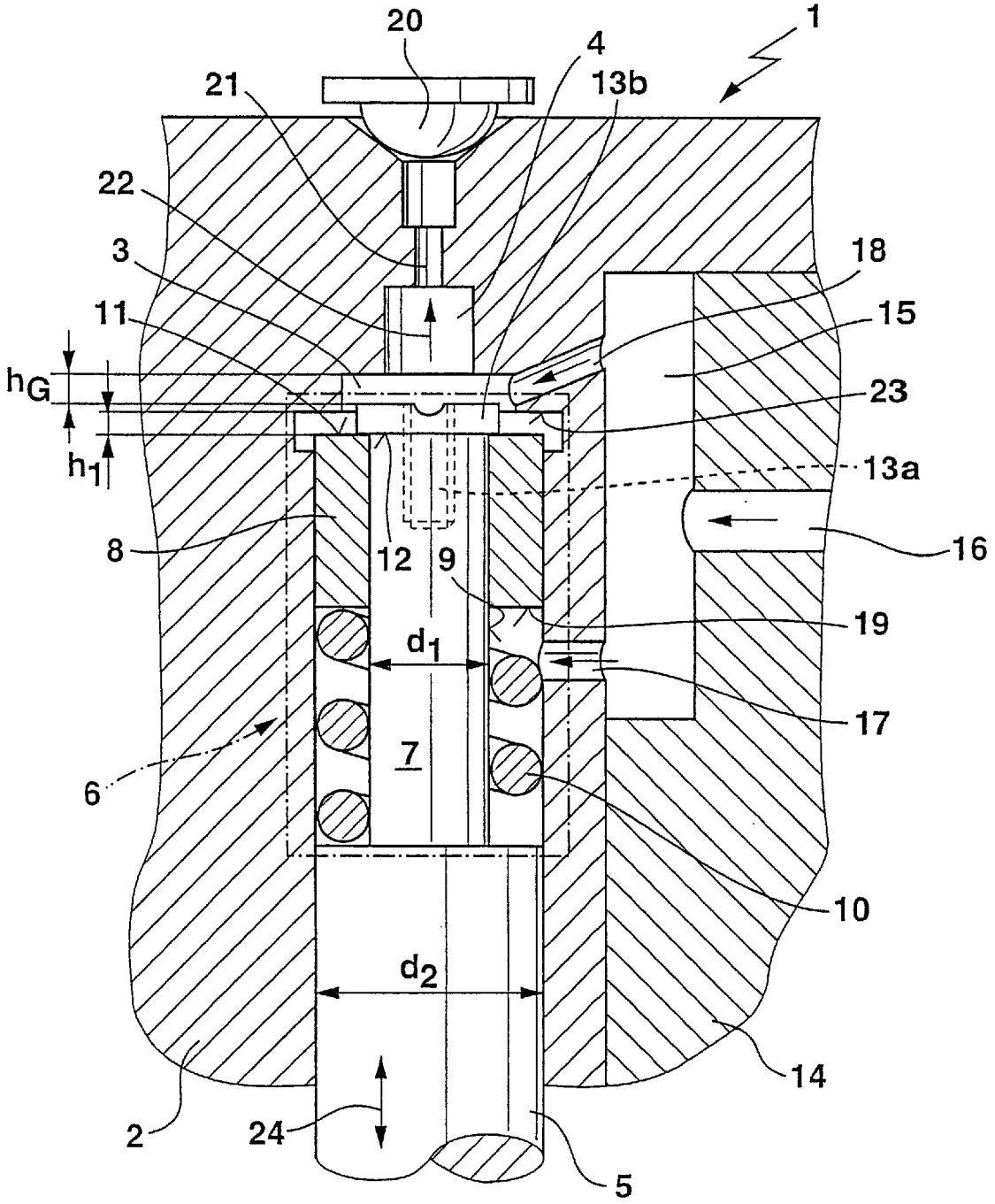
20
1
4
21
13b
22
3
18
11
15
$h_G$
23
$h_1$
13a
8
12
9
16
19
$d_1$
17
7
6
10
$d_2$
14
2
24
5

VALVE CONTROL UNIT FOR A FUEL INJECTION VALVE

PRIOR ART

The invention is based on a valve control unit for a fuel injection valve for a common rail injector.

A valve control unit of this type is known, for example, from EP 0 661 442 A1.

Valve control units of this type are provided for controlling the injection process in the preinjection and main injection of fuel (diesel fuel) in common rail injectors. The valve control unit influences the impingement of pressure on the one end of a movably supported valve control piston of the valve control unit. The other end of the valve control piston can act on an injector needle so that the injector needle either closes an injection opening or permits fuel to escape from the injection opening.

With the known valve control unit, the impingement of pressure on the valve control piston is carried out by changing the pressure conditions inside a first valve control chamber, which communicates with a high pressure reservoir (common rail) by way of a supply conduit. When the valve control unit is triggered, an outlet conduit is opened, which is connected to a second valve control chamber that continuously communicates with the first valve control chamber. As a result, the pressure in the first valve control chamber decreases and the hydraulic force on the valve control piston decreases. Disadvantageously, a large-volume end member connected to the valve control piston must be moved inside the first valve control chamber. Due to the stroke motion of the valve member, during the preinjection, the injected quantity of fuel cannot be sufficiently minimized. During the main injection, it is likewise disadvantageous that a large volume of fuel inside the first valve control chamber must be displaced by the end member when the valve control piston moves away from the injection opening. This prevents an increased movement speed of the valve control piston and therefore also of the injector needle during the main injection.

ADVANTAGES OF THE INVENTION

The valve control unit according to the invention, for a fuel injection valve for a common rail injector operates to minimize the quantity of preinjected fuel and to increase the movement speed of the valve control piston.

Whereas the end member in the prior art is comprised of one part, this invention is comprised of two parts: an inner structural member and an outer structural member. The two structural members can be moved in relation to each other and are connected to the valve control piston. When the outlet conduit is opened and fuel escapes from the first valve control chamber into the second valve control chamber, the two structural members of the end member can move inside the first valve control chamber. During the preinjection, the two structural members move together by a small stroke, whereas during the main injection, only the inner structural member moves by an additional stroke. This results in the fact that during the preinjection, due to the movement of the valve control piston, a greater volume of fuel must first be displaced from the first valve control chamber by the end member (inner and outer structural member). Therefore, the valve control piston can only execute a small stroke. The preinjected quantity of fuel is therefore kept low. In contrast, during the main injection, only the inner structural member of the end member moves so that a smaller volume of fuel has to be displaced from the first valve control chamber. The valve control piston can therefore be moved with an increased movement speed and a larger stroke.

In a preferred embodiment, the first valve control chamber has a first stop to limit the movement of the outer structural member in the direction of the second valve control chamber and has a second stop to limit the movement of the inner structural member in the direction of the second valve control chamber. Through the embodiment of the two stops, the movement of the structural members inside the first valve control chamber is executed in a definite and reproducible manner. A uniform small quantity of fuel is always preinjected, without impairing the increased movement speed during the main injection.

Other advantages and advantageous embodiments of the subject of the invention can be inferred from the specification, the drawing, and the claims.

DRAWING BRIEF DESCRIPTION OF THE

An exemplary embodiment of the valve control unit according to the invention is shown in the drawing and will be explained in the description that follows.

The sole FIGURE shows a longitudinal section through a valve control unit according to the invention.

DESCRIPTION OF THE EXEMPLARY EMBODIMENT

The exemplary embodiment of a valve control unit 1 is disposed in a rest position in which the injection opening, which is not shown in the FIGURE, is closed.

In order to open and close the injection opening, a housing body 2 of the valve control unit 1, as a central subject, has a first valve control chamber 3 and a second valve control chamber 4. The change of the pressure conditions inside the valve control chambers 3 and 4 can influence the movement of a valve control piston 5. The valve control piston 5 has an end member 6 which is comprised of an inner structural member in the form of a piston section 7 and an outer structural member in the form of a control ring 8. The control ring 8, which is concentric to the piston section 7, is movably disposed on an outer circumference surface 9 of the piston section 7. A compression spring 10 presses the control ring 8 with an annular face 11 against an opposing face 12. A fastening plate **13*b* is connected to the piston section 7 by means of a fastening screw 13*a* and has the opposing face 11 to support the compression spring 10. The control ring 8** is therefore fastened under initial stress.

A housing part 14 connected to the housing body 2 has a pressure chamber 15 which communicates with a high pressure reservoir (common rail) via a connecting conduit 16. The pressure chamber 15 has an inlet bore 17 from which fuel can escape. By means of an inlet conduit in the form of an inlet throttle 18, fuel can flow into the first valve control chamber 3. The inlet bore 17 makes it possible for highly pressurized fuel (diesel fuel) to exert pressure on an underside 19 of the control ring 8. If a valve ball 20, which is part of a conventional solenoid valve not shown in the FIGURE, then unblocks an outlet conduit in the form of an outlet throttle 21, the pressure decreases inside the second valve control chamber. As a result, the pressure also decreases inside the first valve control chamber 3. Fuel can flow out in the arrow direction 22. The end member 6 with an outer diameter $d_2$ therefore first moves by the stroke $h_1$. The control ring 8 therefore comes into contact with the annular face 11 against a wall surface 23 of the first valve control chamber 3. Because of the stop, the control ring 8 cannot move further in the direction of the outlet conduit 21. Only a small quantity of fuel is preinjected. During the main injection, the piston section 7 with an outer diameter $d_1$ can then be additionally moved by the stroke $h_G-h_1$. The total stroke is labeled $h_G$. During the main injection, a structural member of the end member 6, namely the piston section 7, is moved, which has a cross sectional area that is reduced in comparison to the total cross sectional volume of the end member 6. A smaller volume of fuel must be displaced from the first valve control chamber 3 into the second valve control chamber 4. The piston section 7 can therefore move more rapidly than the entire end member 6 with its larger structural size. Therefore viewed in terms of the whole, what is achieved is that a smaller quantity of fuel is displaced during the preinjection and an increased movement speed of the valve control piston 5 is possible during the main injection.

When the injector needle, not shown, closes due to the movement of the valve control piston 5 in the arrow direction 24, the piston section 7 first moves away from the second valve control chamber 4 in the opposite order from the opening process. Then, the control ring 8 is also moved back into its rest position so that the injection opening is closed again.

The foregoing relates to a preferred exemplary embodiment of the invention, it being understood that other variants and embodiments thereof are possible within the spirit and scope of the invention, the latter being defined by the appended claims.

What is claimed is:

1. A valve control unit for a fuel infection valve, comprising a housing body (2), said housing body including first and second valve control chambers (3, 4) that continuously communicate with each other, a valve control piston (5) includes an end member (6) which is movable inside the first valve control chamber (3), an inlet conduit (18) for fuel communicates with said first valve control chamber (3), and the second valve control chamber (4) communicates with an outlet conduit (21) that can be closed and opened by a valve ball (20), the end member (6) is comprised of an inner structural member (7) and an outer structural member (8) that can move in relation to each other, and in which the inner structural member (7) is rigidly connected to the valve control piston (5) at one end and that an end plate **(13*b*) is secured to another end of said inner structural member (7) for securing the outer structural member (8) on the inner structural member (7)** with initial stress.

2. A valve control unit for a fuel infection valve, comprising a housing body (2), said housing body including first and second valve control chambers (3, 4) that continuously communicate with each other, a valve control piston (5) includes an end member (6) which is movable inside the first valve control chamber (3), an inlet conduit (18) for fuel communicates with said first valve control chamber (3), and the second valve control chamber (4) communicates with an outlet conduit (21) that can be closed and opened by a valve ball (20), the end member (6) is comprised of an inner structural member (7) and an outer structural member (8) that can move in relation to each other, in which the structural members (7, 8) are disposed concentric to each other, and in which the inner structural member (7) is rigidly connected to the valve control piston (5) at one end and that an end plate **(13*b*) is secured to another end of said inner structural member (7) for securing the outer structural member (8) on the inner structural member (7)** with initial stress.

3. The valve control unit according to claim 1, in which the inner structural member (7) is an end section of the valve control piston (5), which is formed by a step-like transition from a larger outer diameter ($d_2$) to a smaller outer diameter ($d_1$) of the valve control piston (5) and that the outer structural member (8) is a control ring.

4. The valve control unit according to claim 2, in which the inner structural member (7) is an end section of the valve control piston (5), which is formed by a step-like transition from a larger outer diameter ($d_2$) to a smaller outer diameter ($d_1$) of the valve control piston (5) and that the outer structural member (8) is a control ring.

5. A valve control unit for a fuel infection valve, comprising a housing body (2), said housing body including first and second valve control chambers (3, 4) that continuously communicate with each other, a valve control piston (5) includes an end member (6) which is movable inside the first valve control chamber (3), an inlet conduit (18) for fuel communicates with said first valve control chamber (3), and the second valve control chamber (4) communicates with an outlet conduit (21) that can be closed and opened by a valve ball (20), the end member (6) is comprised of an inner structural member (7) and an outer structural member (8) that can move in relation to each other, and in which a first stop is embodied on said housing body (2) to limit a movement of the outer structural member (8) in a direction of the second valve control chamber (4) and a second stop is embodied to limit a movement of the inner structural member (7) in the direction of the second valve control chamber (4).

6. The valve control unit according to claim 1, in which a first stop is embodied on said housing body (2) to limit a movement of the outer structural member (8) in a direction of the second valve control chamber (4) and a second stop is embodied to limit a movement of the inner structural member (7) in the direction of the second valve control chamber (4).

7. The valve control unit according to claim 2, in which a first stop is embodied on said housing body (2) to limit a movement of the outer structural member (8) in a direction of the second valve control chamber (4) and a second stop is embodied to limit a movement of the inner structural member (7) in the direction of the second valve control chamber (4).

8. The valve control unit according to claim 5, in which the stops are embodied inside the first valve control chamber (3).

9. The valve control unit according to claim 6, in which the stops are embodied inside the first valve control chamber (3).

10. The valve control unit according to claim 7, in which the stops are embodied inside the first valve control chamber (3).

11. A valve control unit according to claim 1, which includes a housing part (14) connected to said housing body (2), a pressure chamber (15) formed between said housing part (14) and said housing body (2), a fuel inlet conduit (16) connected via said housing part (14) to supply fuel to said pressure chamber (15), a bore (17) which passes fuel from said chamber (15) to a chamber surrounding said piston section (7), and said inlet conduit (18) passes fuel from said chamber (15) to said first valve control chamber (3).

* * * * *